United States Patent [19]

Ichikawa

[11] Patent Number: 4,473,219

[45] Date of Patent: Sep. 25, 1984

[54] GATHERER WITH BINDING MECHANISM FOR PAPERS DISCHARGED FROM A BIN DRUM

[75] Inventor: Kiyomichi Ichikawa, Kawasaki, Japan

[73] Assignee: Autostamp Institution Limited, Tokyo, Japan

[21] Appl. No.: 512,165

[22] Filed: Jul. 8, 1983

[30] Foreign Application Priority Data

Jul. 14, 1982 [JP] Japan ..... 57-122581
Mar. 16, 1983 [JP] Japan ..... 58-43816

[51] Int. Cl.[3] ..... B42B 1/02

[52] U.S. Cl. ..... 270/53; 270/60; 271/187

[58] Field of Search ..... 270/53, 55, 60, 13, 270/18; 271/315, 187

[56] References Cited

U.S. PATENT DOCUMENTS 3,912,255 10/1975 Mcinerny ..... 271/187
3,951,399 4/1976 Reist ..... 270/60
4,058,202 11/1977 Reist et al. ..... 270/55 X
4,381,106 4/1983 Loebach ..... 270/60
4,398,710 8/1983 Hansch ..... 270/55
4,416,448 11/1983 Meier ..... 270/55
4,431,178 2/1984 Kokubo et al. ..... 271/187

FOREIGN PATENT DOCUMENTS 597109 8/1959 Italy ..... 271/187

*Primary Examiner*—E. H. Eickholt

[57] ABSTRACT

A gatherer comprises a generally cylindrical bin drum having circumferentially thereon a plurality of inclined shelves spaced apart each other for receiving papers. The gatherer further comprises a paper-size changing body and a switching means for the changing body. The gatherer thus constructed has a number of advantages, such as convenient and rapid introduction and discharge of the papers, accurate alignment of the papers, convenient and simple control of the introduction and the discharge of the papers through rotation direction of the bin drum and applicability to any paper size, as well as high performance with compact and simple construction and so forth.

2 Claims, 15 Drawing Figures

GATHERER WITH BINDING MECHANISM FOR PAPERS DISCHARGED FROM A BIN DRUM

FIELD OF THE INVENTION

This invention relates to a gatherer for papers, more particularly to a gatherer for automatically aligning and binding copied papers.

BACKGROUND OF THE INVENTION

Recently, a copying machine has been improved in its copying speed and in its additional means for feeding originals. With the functional improvement, many types of paper-aligning apparatus, so-called "sorters" have been developed. However, these sorters have only function of aligning papers into a plurality of bins but operation such as removal of the aligned papers, alignment of the paper edges, binding and punching thereof must be carried out manually. In order to come up with the considerable improvement of the copying machine, mechanical and automatical post-treatment of the copied papers is required.

In order to satisfy the requirement, an improved sorter has been proposed by the applicant, which may aligning edges of the copied papers, binding and then discharging the same. However, this type of sorter has shortcomings in that papers are held by an annular belt and recycled in a transporting path, generating static electricity which causes difficulty in the alignment of paper edges and in that the belt may restrict the number of papers to be aligned. Further, the alignment through the transporting path may arise another disadvantage in that the set number of papers depends on the path length so that increase of the set number may cause the apparatus large and complicated.

SUMMARY OF THE INVENTION

An object of the invention is to eliminate the disadvantages described hereinbefore and to provide a more improved gatherer for copied papers, which comprises a generally cylindrical bin drum having circumferentially thereon a plurality of inclined paper-receiving shelves circumferentially spaced apart each other, a paper-holding means arranged in each of the shelves, a paper-transporting path contacted to the bin drum, a paper-distributing mechanism situated at a location of the bin drum contacted with the paper-transporting path, and a binding mechanism arranged near the paper-distributing mechanism for binding a set of paper discharged from the bin drum and aligned, and in which the bin drum is rotated over an open length of each shelf per one piece of paper in the paper-transporting direction for successively introducing the paper into the shelf and is rotated, after having finished the introduction of the paper, in the opposite direction over the open length of the shelf thereby to introduce the set of aligned papers into the binding mechanism.

In accordance with the invention, the gatherer may further comprise, in each shelf of the bin drum, a paper size changing body capable of reciprocating a paper-engaging pawl from a notch of each shelf for engaging with a leading edge of the paper, as well as switching means for swinging the changing body and in which the binding mechanism is movable on a rail arranged along an edge of the set of papers to be bound and is provided with a moving means to be switched by the paper size so as to aligning a center of the binding mechanism with a central position of the edge of the set of papers. Thus, papers of different sizes may be aligned and gathered.

The invention will be described hereinbelow in more detail by means of preferred embodiments with reference to the accompanying drawings.

PREFERRED EMBODIMENTS OF THE INVENTION

Figure 4:
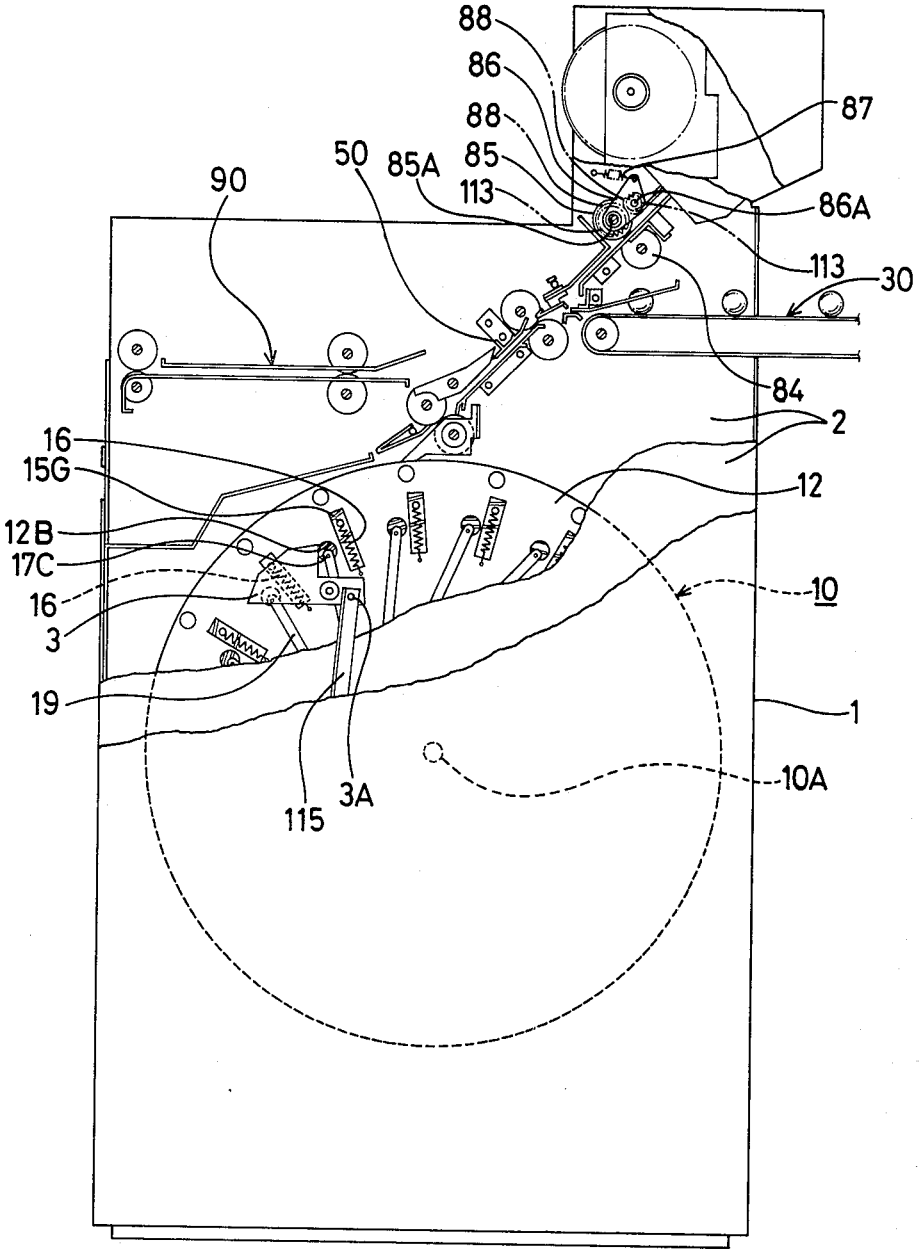
FIG. 4 is a partially omitted vertical section of the gatherer according to the invention.

In FIG. 4, a bin drum 10 is in the generally cylindrical form and is mounted to a plate 2 within a frame 1. The bin drum 10 is provided with a plurality of paper-receiving shelves 11, or so-called bins, circumferentially spaced apart each other which are inclined to the circumference of the drum. In other word, these shelves 11 are arranged in the convoluted form in section, as best shown in FIG. 5.

In the illustrated bin drum 10, shelf plates 13 having the curvature corresponding to the outer configuration of the drum 10 and being arcuately bent are fixed to a pair of circular side plates 12 in such a way that each shelf plate 13 is arranged convolutedly at the circumferential edge of the side plate 12. In order to form a space between the adjacent shelves 13 for the paper-receiving shelf 11, a stopper 14 for the paper end is arranged by vertically protruding a portion of the shelf end axially along the drum 10, while a gripper plate 15 is arranged on a surface near the inner end of each shelf 13. Thus, each shelf 11 is formed with the shelf plate 13, the stopper 14 and the gripper plate 15.

Figure 5:
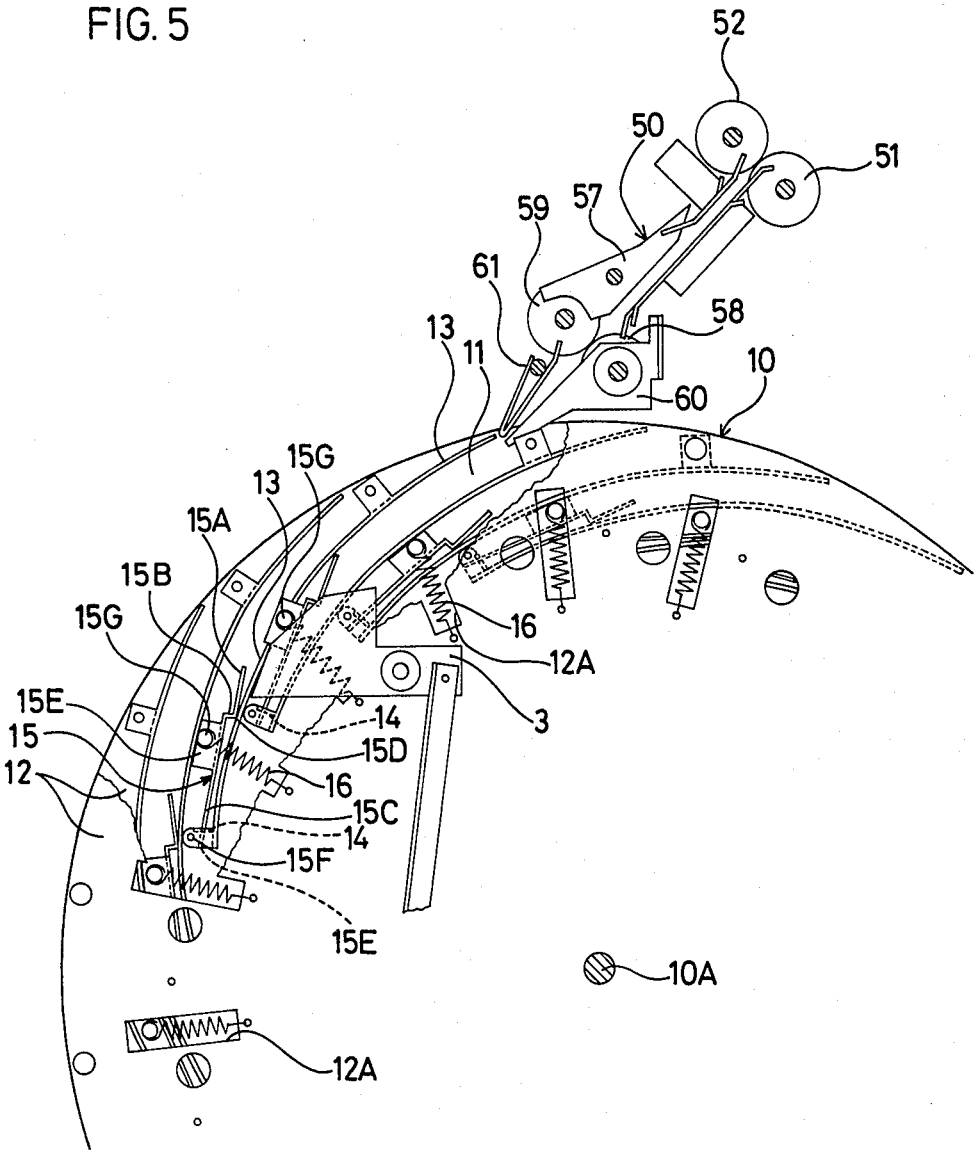
FIG. 5 is a partially broken side view of a paper-holding means of a shelf.

As shown in FIG. 5, the gripper 15 is formed by connecting a paper-guide plate 15A through a step portion 15B to a gripper body 15C. The gripper 15 is constructed by mounting both bent ends 15E of the gripper 15 to the side plate 12 through a pin 15F, so that a bent line 15D of the step 15B may be opposed to the shelf surface and movable relative to the latter to form a space. The side plate 12 is provided with a notch 12A, from which is protruded an engaging protrusion 15G formed in the bent end 15E of the gripper 15. To the protrusion 15G is fixed one end of a coil spring 16, the other end of which is fixed to the side plate 12 in order to normally urging the bent line 15D against the shelf surface.

The protrusion 15G is formed with, for example, a cam follower which may release the paper-holding function of the gripper 15 by urging the same radially outward relative to the drum 10 by means of a gripper-release plate 3 arranged swingably at the frame 1.

Figure 6:
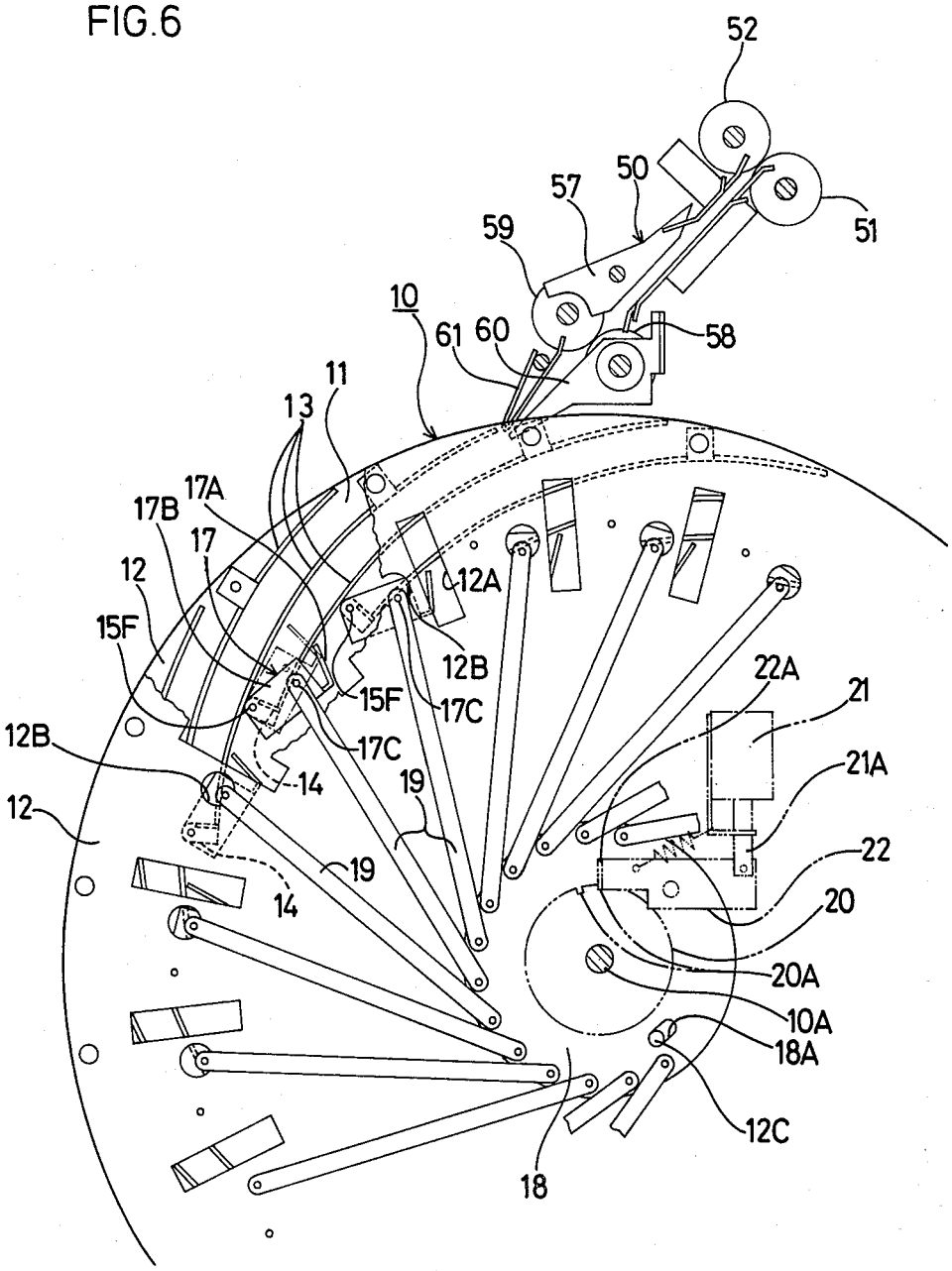
FIG. 6 is a partially broken side view of a paper size changing body.

The shelf plate 13 at its lower end surface is provided with a paper size changing body 17, as illustrated in FIG. 6. The body 17 has function to receive papers of, for example, A-4 size and B-5 size in constant positions of the opening of the shelf 11, respectively. The body 17 is provided at its front end with a plurality of protruded pawls 17A and at its side edge with a swingable plate 17B which is swingably arranged between the shelf plates 13 by means of the pin 15F, so that the pawl 17A may be reciprocated swingably from the shelf notch into the shelf 11.

The swingable plate 17B is provided with a pin 17C which is protruded from the notch 12B of the side plate 12 and is connected through a rod 19 to a switching disc 18 arranged on the side plate 12 of the bin drum 10.

The switching disc 18 is rotatably mounted on a drum shaft 10A in the outer position of the side plate 12 and is restricted its rotation through engagement of an engaging notch 18A of the disc 18 with a corresponding pin 12C protruded from the side plate 12. The disc 18 is provided with a rotatable disc 20 through a friction plate (not shown). The disc 20 is urged by the friction plate and a plate spring (not shown) against the side plate 12. Thus, the rotatable disc 20, the switching disc 18 and the side plate 12 are associated by the frictional force of the plate spring 12. The friction between the side plate and the disc 18 is established smaller than that between the discs 18 and 20 by suitably selecting their contact surface areas and materials.

The rotatable disc 20 at its circumference is provided with a plurality of notches 20A, each of which is engageable with a pawl 22A of an engageable body 22 by means of a switching solenoid 21. The engageable body 22 is provided at its one end with the pawl 22A, a middle of which is pivoted to the plate 2 and the other end of which is associated with a plunger 21A of the solenoid 21.

Thus, the solenoid 21 may be switched ON by a paper-changing signal from a control section, while the paper-size changing body 17 in the shelf 11 may be switched through rotation of the drum 10. Namely, the discs 18 and 20 together with the drum 10 may be rotated at first and then the pawl 22A may be engaged with the notch 20A of the disc 20 to discontinue the rotation of the disc 20, and the associated disc 18.

On the other hand, the drum 10 continues its rotation causing a shift between the disc 18 and the side plate 12, so that the swingable plate 17B may be swung through the rod 19 to change the position of the body 17. Through the switching of the position of the body 17, the A-size paper at its front end is contacted with the stopper 14 without the pawl 17A emerging from the shelf 13 in order to receive the paper. For receiving the B-size paper, the pawl 17A may be emerged from the shelf notch and engaged with the front end of the paper. The position of the protruded pawl 17A is adjusted for the A-size and B-size papers respectively, with the trailing end of the paper.

The shelf 13 is arcuately bent in its section but not limited thereto and may be in the flat form. As illustrated, however, the arcuate form allows a longer paper to be more readily received than the flat form and may achieve more dense arrangement of the shelves 13 in comparison with the flat shelves 13, resulting in a compact type having much more number of shelves 11.

Above the drum 10 thus constructed is arranged a paper-distributing mechanism 50, to which is connected a paper-transporting path 30.

Figure 7:
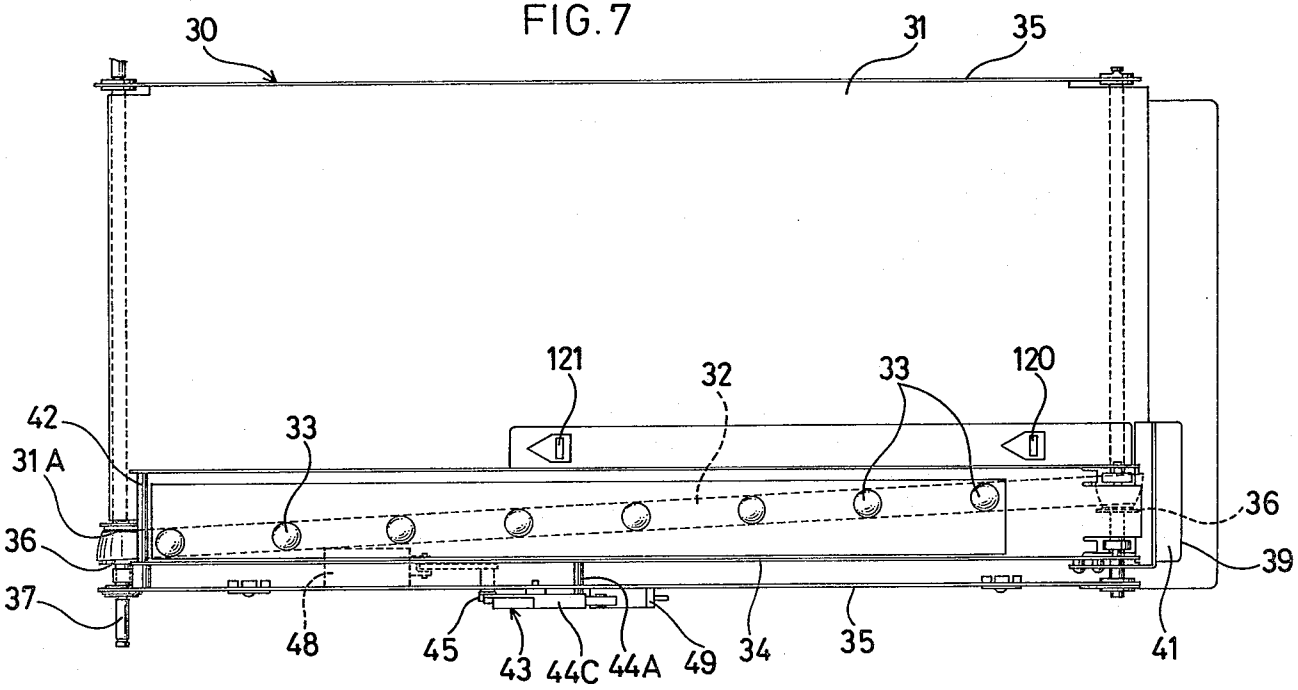
FIG. 7 is a partially broken plan view of a paper inlet means.
Figure 8:
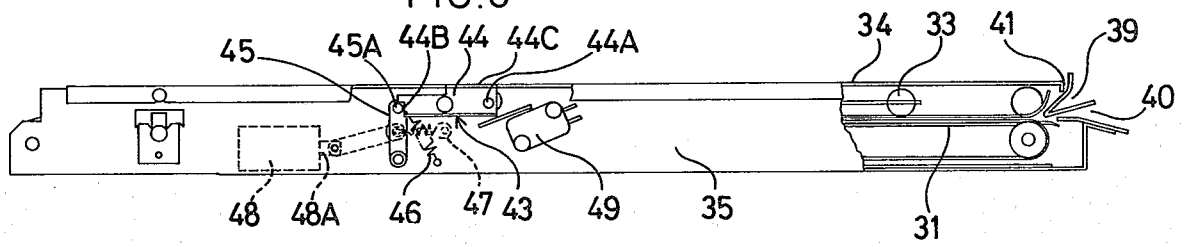
FIG. 8 is a partially broken side view of the paper inlet means of FIG. 7.

As illustrated in FIGS. 7 and 8, the paper-transporting path 30 comprises a paper-introducing plate 31, an inclined belt 32 sliding on the plate 31, a pressure balls 33 contacted onto the belt 32 for urging the paper against the belt 32, and a holding body 34 for holding the balls 33.

The path 30 at its either side edge along the paper passing direction is bent upward to form a paper guide 35. The belt 32 is inclined at a certain angle relative to the guide 35. Namely, the distance between the belt 32 and the guide 35 is gradually reduced in the paper passing direction. Thus, a transporting pulley 36 having the belt 32 is enlarged in its middle circumference, thereby to form a half drum shape.

The pulley 36 is fixed to a pulley shaft 37 which is mounted to a lower part of the guide 35 normally to the paper passing direction, as best shown in FIG. 7. The plate 31 at its location for arranging the pulley 36 is provided with a notch 31A. The pulley shaft 37 at its outer end is connected with a shaft 112 of a driving mechanism 100.

The plate 31 is arranged at the frame 1 via the pulley shaft 37 which is a swing center of the plate 31. Thus, the path 30 may swing to align an inlet of the plate 31 with a paper outlet of any type of copying machine. The path 30 is provided with an angle regulator (not shown) for selectively setting a mounting angle of the plate 31. The angle regulator may be suspended from a stay 4 lying on the frame 1.

Above the inlet end of the path 30 is arranged the paper guide 31 of the V-shape to form an inlet part 40 for the paper. The inlet part 40 diverges outwardly for readily receiving the paper and for convenient connection with a certain allowance to the outlet of the copying machine. In order to manually introduce any other paper rather than copied paper, an paper inlet 41 may be formed by the guide plate 39.

The holding body 34 is supported by a pin 42 which in turn is fixed horizontally to the paper guide 35 at its outlet end. Further, the holding body 34 at its longitudinal middle part is provided with a release means 43 of the ball pressure for lifting the body 34 and releasing the ball load in order to remove the clogged paper, if any, in the paper-transporting path 30.

The release means 43 is arranged at the guide plate 35 and comprises a swingable plate 44, an engageable plate 45, coil springs 46, 47 and a solenoid 48 for swinging the holding body 34, as shown in FIG. 8. The swingable plate 44 at its one end is provided with a mounting pin 44A passing through the holding body 34, while at its other end with a notch 44B for engaging with a pin 45A. The plate 44 at its middle part is supported to the guide plate 35. The engageable plate 45 at its one end is provided with the pin 45A engageable with the notch 44B and at its other end is mounted to the guide plate 35. Its middle part is associated with a plunger 48A of the solenoid 48. In order to keep the holding body 34 in the upper position, the one end is fixed near the notch 44B and the other end is fixed to the guide plate 35 to receive the coil spring 46. In order to keep pulling the body 45 toward the notch 44B, the guide plate 35 at its lower surface is provided with the coil spring 47. Further, a micro-switch 49 is provided for confirming actuation of the holding body 34.

When the paper is clogged, sensors 120, 121 spaced apart at a certain distance in the path 30 may detect the clogging to discontinue the operation and to energize the solenoid 48. The energization of the solenoid 48 allows the engageable plate 45 to swing for releasing the engagement of the swingable plate 44 and thus may allows the holding body 34 to swing upwardly. After removal of the clogged paper, a pressing piece 44C, which is formed by bending the upper end of the swingable plate 44, is urged downwardly to engage the plate 44 with the plate 45 for restoring the lower position of the holding body 34.

Figure 9:
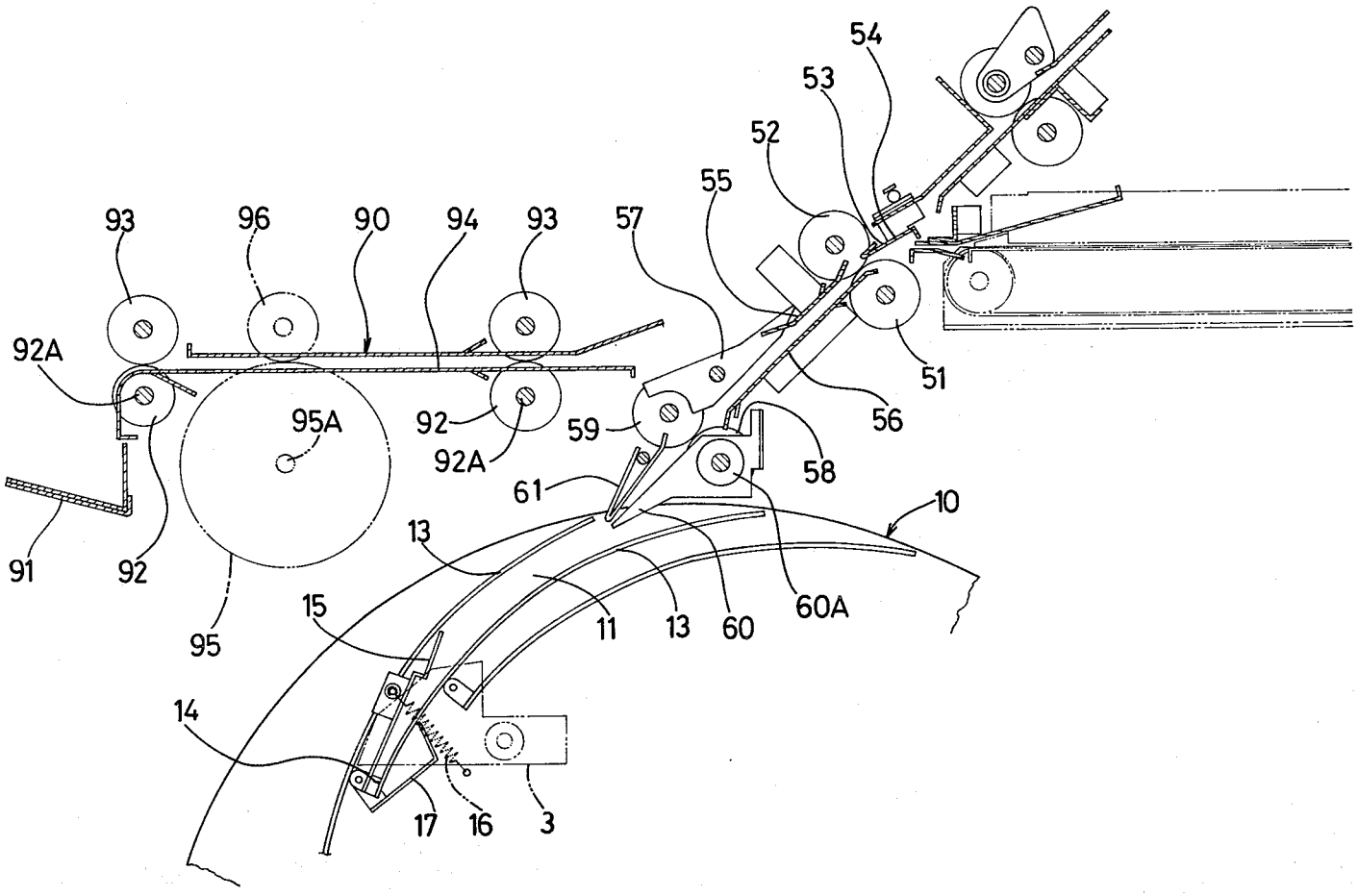
FIG. 9 is a partially broken side view of a paper-distributing mechanism.
Figure 10:
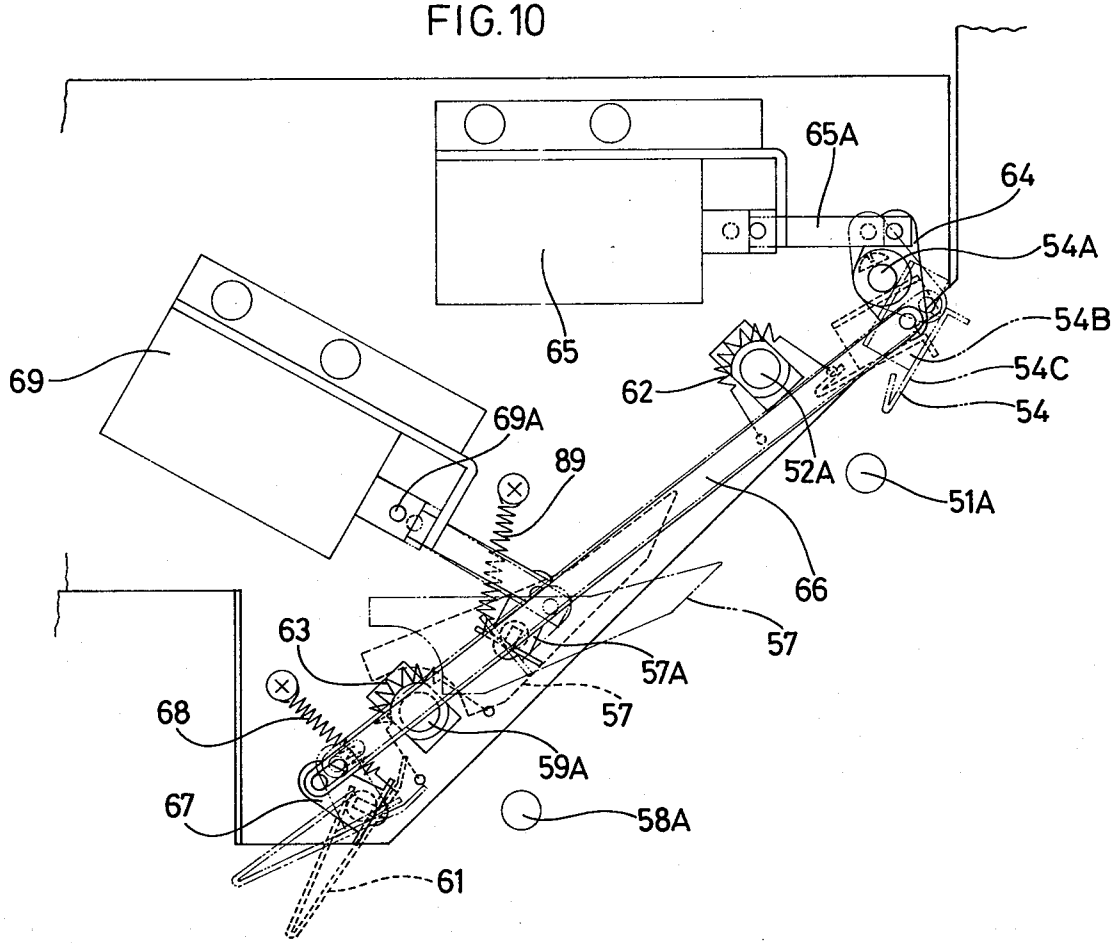
FIG. 10 is a side view showing operation of the paper-distributing mechanism.
Figure 11:
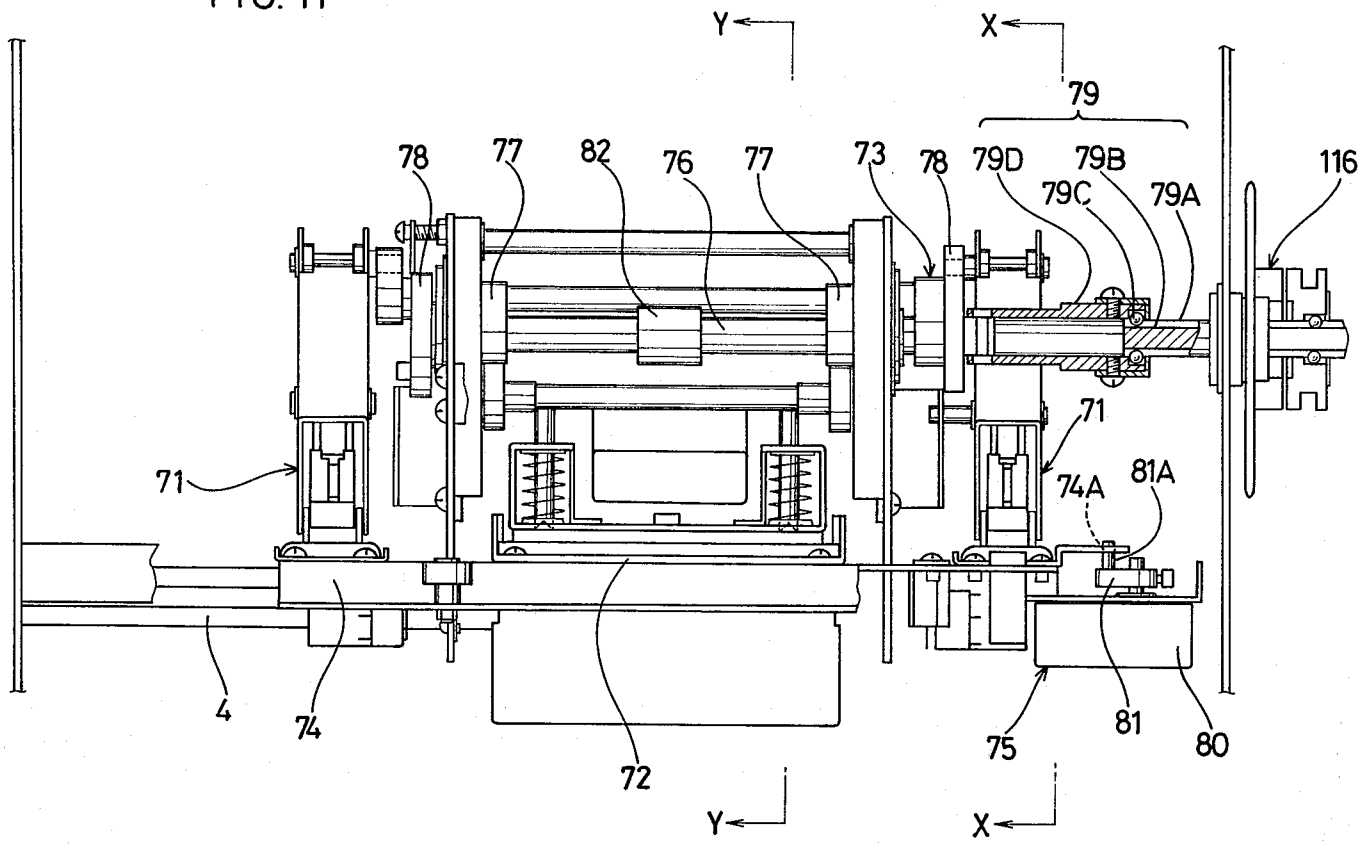
FIG. 11 is a partially broken front view of a binding mechanism.
Figure 12:
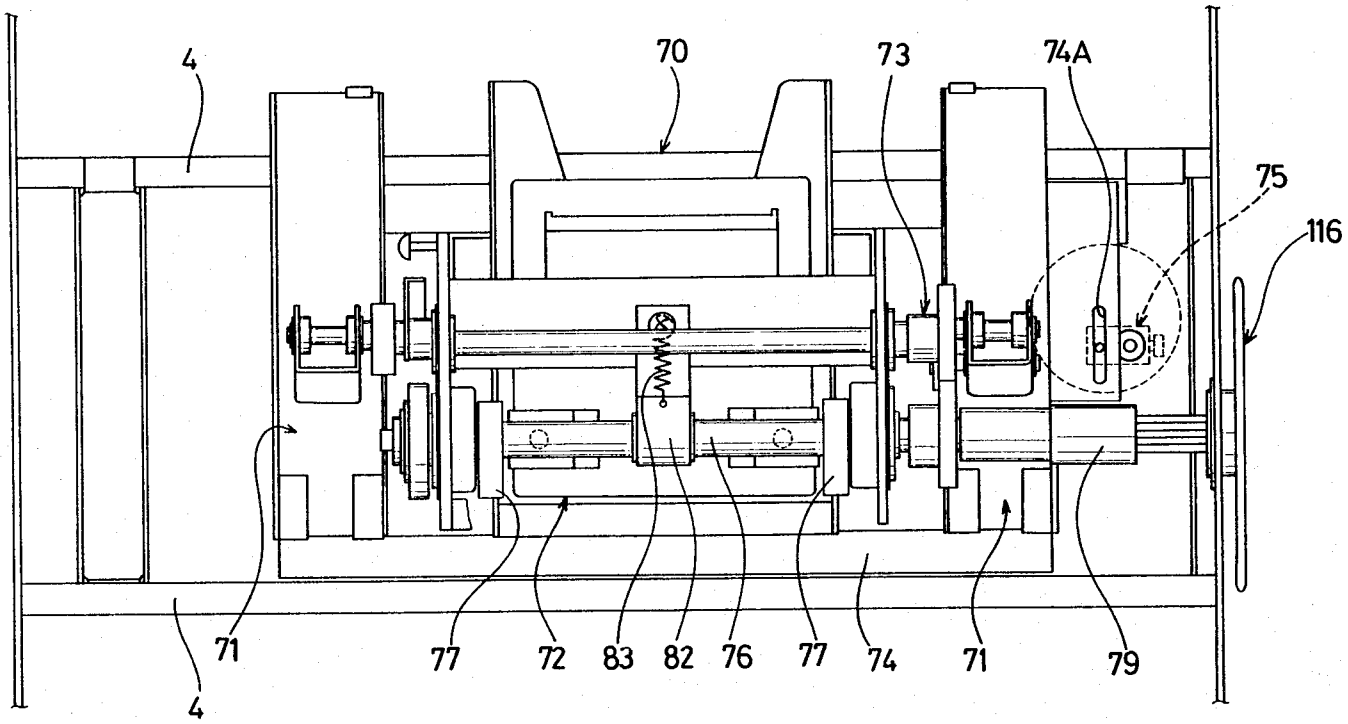
FIG. 12 is a plan view of the binding mechanism.
Figure 13:
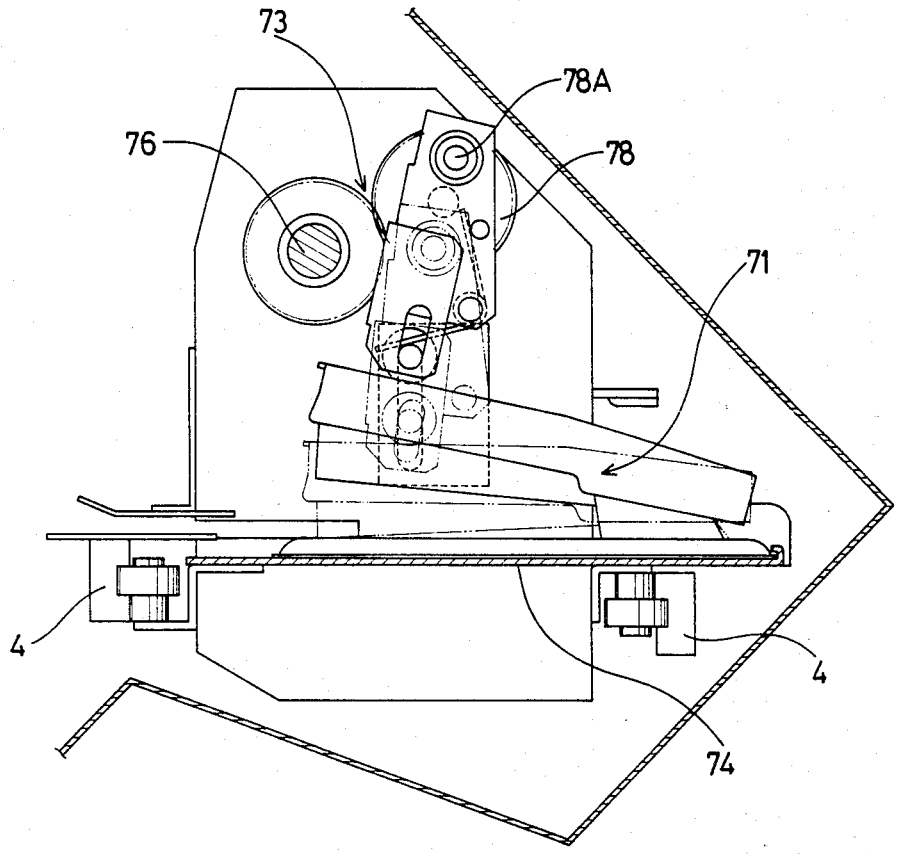
FIG. 13 is a sectional view through the line X—X in FIG. 11.
Figure 14:
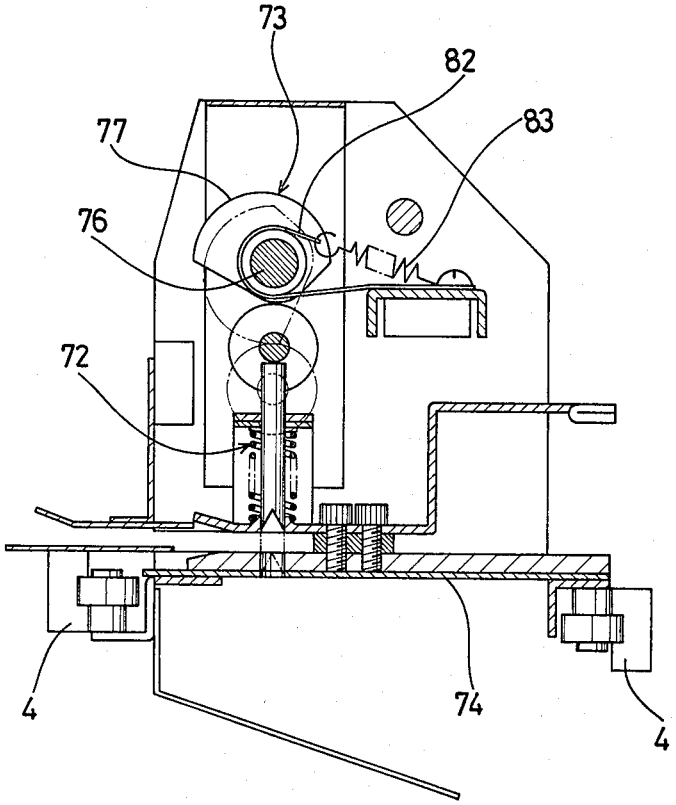
FIG. 14 is a sectional view through the line Y—Y in FIG. 11.

The paper transported through the path 30 may be introduced into each shelf 11 or passed over the bin drum 10 by means of the paper-distributing mechanism 50. As illustrated in FIGS. 9 and 10, the mechanism 50 comprises a gate roller 51, a press gate roller 52 contacting resiliently with the roller 51 and rotating oppositely thereto, a holding part 53 formed between the rollers 51 and 52, an inlet gate 54 above the holding part 53, an upper and an lower guide plates 55, 56 arranged in parallel under the holding part 53, an outlet gate 57 arranged in parallel to the plate 56 and in the extending direction of the plate 55, a shelf roller 58 and a press shelf roller 59 contacting resiliently with the roller 58 and rotating oppositely thereto each arranged under the plates 56, 57, as well as a shelf gate 60 and a press gate 61 each arranged under the rollers 58, 59.

The gates 60 and 61 at their front ends are normally situated within the bin drum 10 and ensure the instruction and discharge of the paper relative to the shelf 11. For this purpose, at a location arranging the gates 60, 61 of the shelf plate 13 is formed a notch to ensure the rotation of the drum 10. The gate roller 51 and the shelf roller 58 may be forcibly rotated by the driving mechanism 100, as described hereinafter. The press roller 52 and the shelf roller 59 are supported to the plate 2 of the frame 1, similarly to the rollers 51 and 58, and their shaft holes correspond to a thickness of a set of papers transported to a binding mechanism 70 and are in the elongated form for permitting outer escape relative to the rollers 51, 58 for corresponding to a thickness of a single piece of paper. Further, coil springs 62, 63 are half-wound around roller shafts 52A, 59A for normally urging the rollers 52, 59 against the rollers 51, 58. These rollers 51, 52, 58, 59 are divided into groups and mounted to each shaft 51A, 52A, 58A, 59A at suitable distances. The gate roller 51 and the press roller 59 are secured to the shafts 52A and 59A, respectively, while the rollers 52 and 59 are rotatably mounted to the shafts 52A, 59A without shifting axially.

As shown in FIG. 10, the inlet gate 54 is supported to the plate 2 of the frame 1 through a protrusion 54A by fixing a plate 54B having the protrusion 54A to either ends of a gate body 54C consisting of a flat plate. The protrusion 54A is securely provided at its one end with a swingable lever 64, a top end of which is connected to a plunger 65A of a solenoid 65. Further, the lever 64 is associated through a rod 66 with a swingable lever 67 of the gate 61. To the lever 67 is mounted a coil spring 68 for normally pulling the lever 67 downwardly. Thus, the gate 61 may be kept downward by the spring 68 unless the solenoid 65 is energized. Further, the inlet gate 54 may be swung by the rod 66 for introducing the paper into the holding part 53. Upon energization of the solenoid 65, the lever 64 changes its swung position for allowing the inlet gate 54 to swing downwardly and the press gate 61 to swing upwardly in order to withdraw the set of papers from the shelf 11.

The shelf gate 60 is vertically movable and arranged on the stay 4. The notch 60A is formed large enough to prevent the roller shaft 58 from being contacted therewith upon the vertical movement. The gate 60 at its front end is pulled downwardly by the coil spring (not shown).

Thus, the gate 60 serves to pick up the paper for discharging upon reverse rotation of the drum 10, while it moves vertically over the previously introduced paper upon normal rotation of the drum 10.

Further, the gate 61 operates together with the gate 60 upon introduction of the paper into the shelf 11, but may swing vertically in order to ensure the discharge of the paper from the drum 10.

The outlet gate 57 is associated through the lever 57A with the plunger 69A of the solenoid 69. The gate 57 at its front end is normally pulled downward by the coil spring 89 but may be swung upward through energization of the solenoid 69 to guide the paper toward the shelf 11.

Diagonally above the holding part 53 and in the extending direction of the guide plate 55, 56 is arranged the binding mechanism 70, which comprises, as shown in FIGS. 11 to 14, a stapler 71 for binding the paper edge, a puncher 72 for forming a binding hole, a driving means 73 for the stapler 71 and the puncher 72, a mounting table 74 arranged movably along the paper edge in the longitudinal direction of the stay 4 for mounting the stapler 71, the puncher 72 and the driving means 73, as well as a moving means 75 for moving the table 74 to the center position of the paper edge to be bound depending on the paper size.

The stapler 71 and the puncher 72 may be of any known type and at their bottom are removably fitted into a mounting groove (not shown) provided in the table 74.

The driving means 73 may urge downwardly the pressing part of the stapler 71 and the puncher 72 by means of an eccentric cam 77 fixed to a driving shaft 76 and a pin 78A fixed to the peripheral edge of a disc 78. The driving shaft 76 is associated with an electromagnetic clutch 116 through an extensible joint 79 comprising a spline shaft 79A, balls 79C engaging with a key groove 79B of the shaft 79A and a shaft 79 for holding the balls 79C. The electromagnetic clutch 116 is associated with a motor 101 via a chain 102 and may rotate the driving shaft 7 one time per each signal from a control mechanism.

The moving means 75 is provided with a notch 74A which is elongated normally to the moving direction of the table 74. Into the notch 74A is engaged a pin 81A provided at an end of a swingable arm 81 of a motor 80. The motor 80 may allow the arm 81 to rotate half through a paper-changing signal from the control mechanism. A brake plate 82 having a friction material, such as a felt, is provided at a contact surface with the driving shaft 76. The brake plate 82 is wound half around the driving shaft 76 and is urged resiliently against the shaft 76 by means of a coil spring 83 for preventing rotation due to the cam weight.

The inlet of the binding mechanism 70 is provided with rollers 84 and 85 for receiving the paper set, as illustrated in FIG. 4. The roller 85 is swingably supported to a swingable plate 86 in order to receive the paper set depending on its thickness, and is urged resiliently against the roller 84 by a coil spring 87. A rotational force is given not only to the roller 84 but also to the roller 85 through a shaft of the swingable plate 86 and a gear 88. Thus, the rollers 84, 85 pressing the paper set from either side and rotating at the same rate may prevent the papers from being rubbed each other and transport the paper set while keeping alignment of the paper edge.

An upper cover 5 for the binding mechanisms 70 is openable for conveniently filling needless into the stapler 71 and mounting or removing the puncher 72.

The paper set provided with a binding hole is guided to a discharging path 90 through the outlet gate 57 of the distributing mechanism 50 and transported to a receiver 91. The discharging path 90 comprises a plurality of rollers 92, a plurality of press rollers 93 resiliently contacted therewith and rotating oppositely thereto, a guide plate 94 arranged horizontally between the rollers 92, a printing drum 95 optionally arranged in the central part of the guide plate 94, and a platen 96, as shown in FIG. 9.

The rollers 93 and the platen 96 are supported to the plate 2 through an elongated hole for allowing escape relative to the rollers 92, similarly to other rollers, such as the gate roller 52 and the shelf roller 92. A pulling coil spring is wound on a shaft of the roller 93 for normally urging the latter to the roller 92. Thus, the roller 93 and the platen 96 may escape from the roller 92 for ensuring transportation of different thickness of the paper set and avoiding an excessive load onto the rollers 92, 93.

The introducing path 30, the bin drum 10, the rollers 51, 58 of the distributing mechanism 50, the binding mechanism 70 and the discharging path 90 may be driven by the driving mechanism 100, which may be controlled by the control mechanism (not shown).

Figure 15:
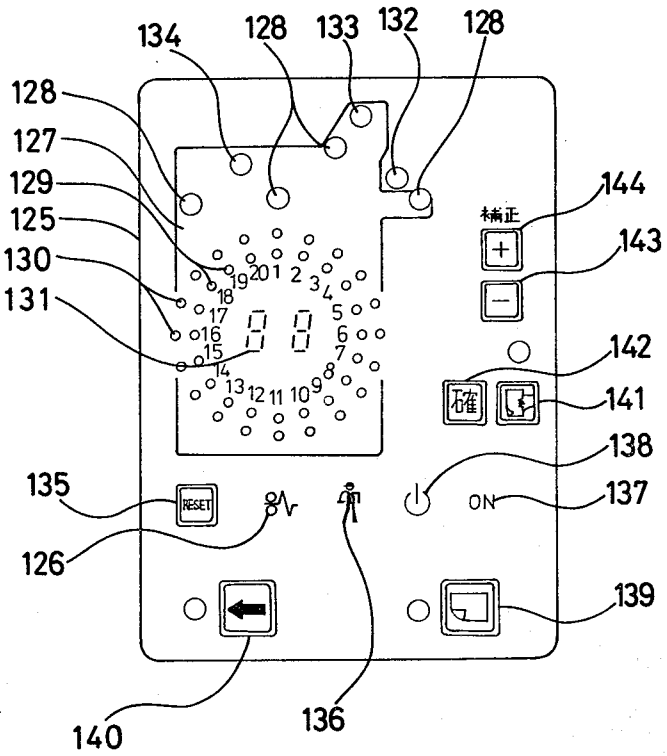
FIG. 15 is a plan view of the control panel.
Figure 1:
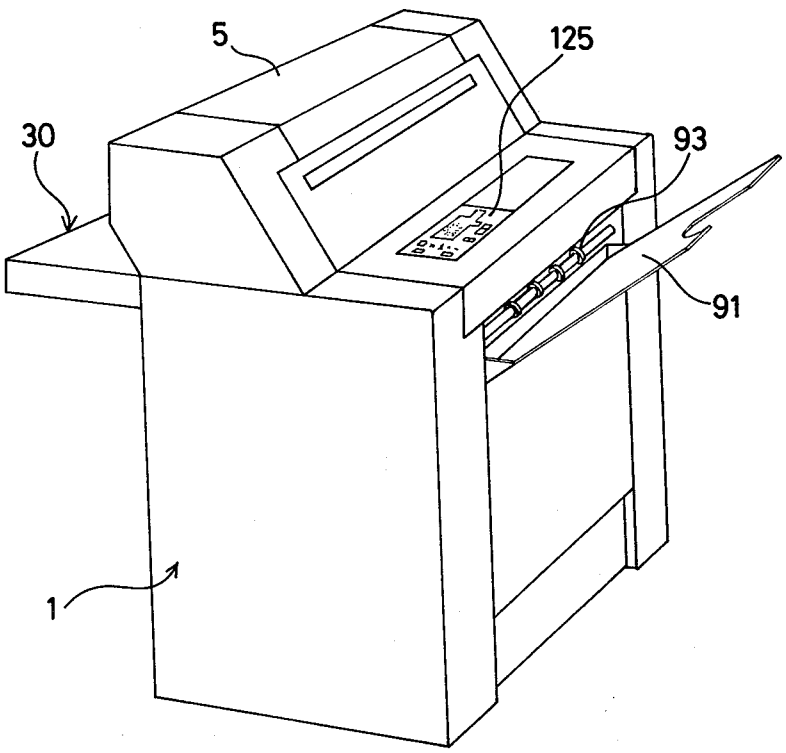
FIG. 1 is a perspective view of a gatherer according to the invention.
Figure 2:
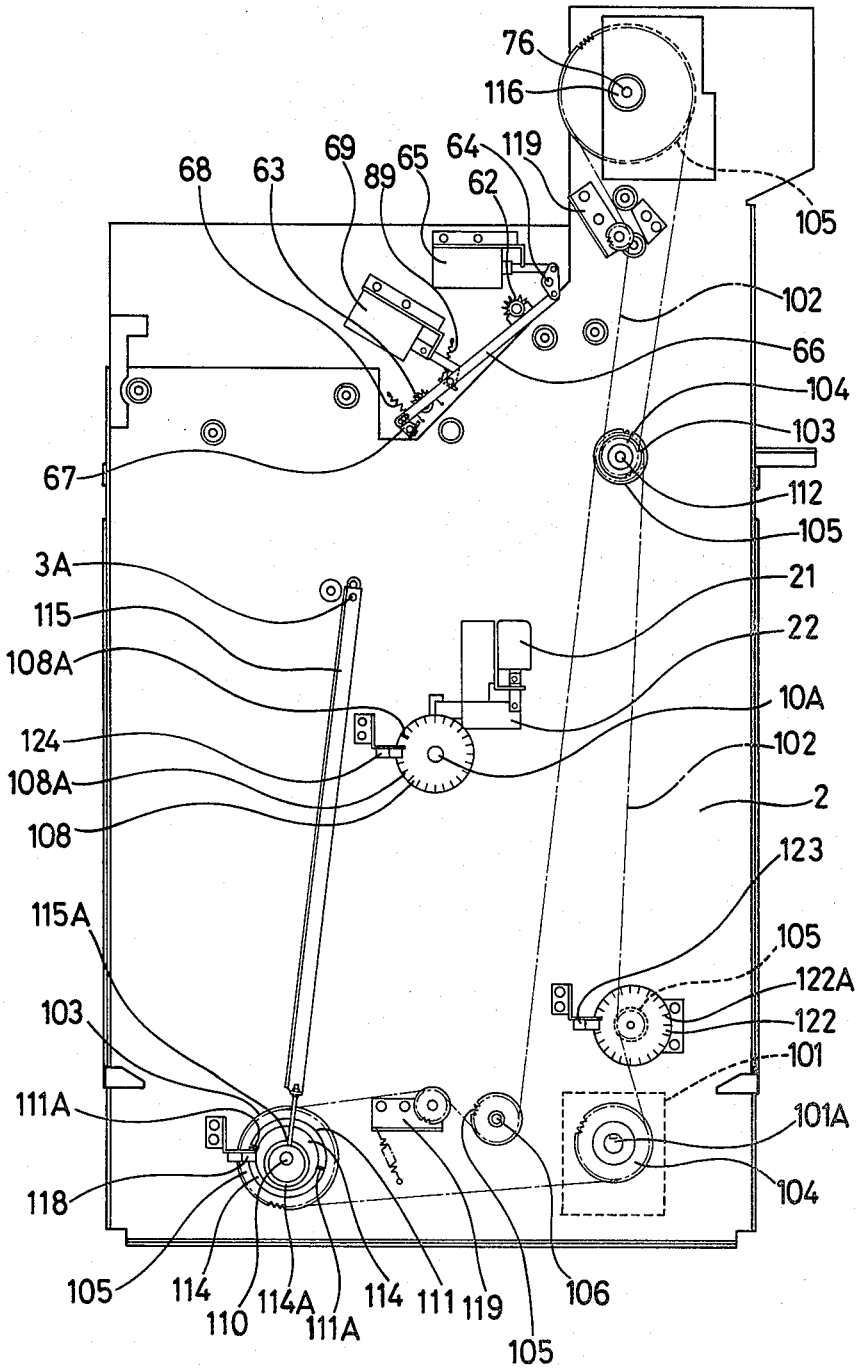
FIG. 2 is a right side view of the gatherer of FIG. 1.
Figure 3:
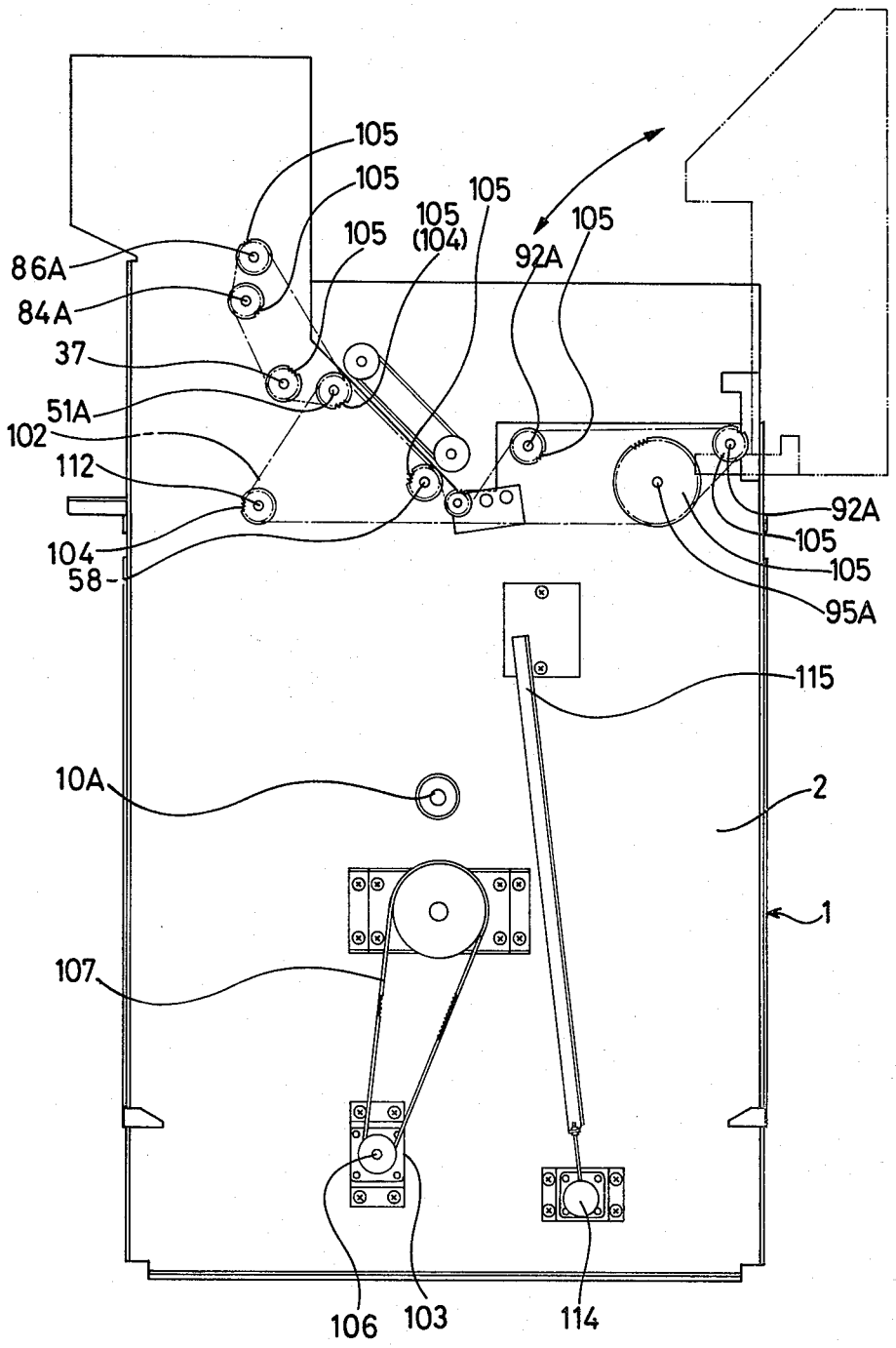
FIG. 3 is a left side view of the gatherer of FIG. 1.

As illustrated in FIGS. 2 and 3, the driving mechanism 100 transmits a driving force of the motor 101 (arranged under the frame 1) to a shaft of each mechanism described hereinabove through a transmitting means, such as a chain 102 and if necessary an intermediate electromagnetic clutch brake 103. Namely, a motor driving shaft 101A extended from the plate 2 is securely provided with a driving sprocket 104, while each shaft extended from the plate 2 is provided with a follower sprocket 105. Between these sprockets 104 and 105 is arranged the chain 102.

As shown in FIG. 3, the bin drum 10 is rotated via a drum shaft 106 with the electromagnetic clutch brake 103, a belt 107 and a gear (not shown). As shown in FIG. 2, a disc 108 having slits 108A fixed to the drum shaft 10A is provided for detecting a rotation angle of the bin drum 10. Each slit 108A is formed in the peripheral edge of the disc 108 over the range of the shelf 11, wherein one slit 108A is formed larger than the other slit 108A. The shelf 11 corresponding to the larger slit 108A serves as the first receiving shelf 11. These slits 108A may be detected by a sensor 124, such as a photo-sensor, for detecting the stop position of the drum 10.

As shown in FIG. 2, the gripper-releasing plate 3 for releasing the holding of the paper by the gripper plate 15 is driven by a gripper driving shaft 110 through the electromagnetic clutch brake 103 between the chains 102. The gripper driving shaft 110 may be rotated by half per each gripper-releasing signal or gripper-holding signal through a detector disc 111 for detecting the rotating position which sensor is fixed to the same shaft, as well as sensor 118, such as a photo-sensor, for detecting the stop position, which sensor may detect slits 111A spaced apart at 180° circumferentially on the disc 111.

The gripper driving shaft 110 at its either end is provided with a cam plate 114 having on its circumference an eccentric circle groove 114A, into which is fitted a pin 115A formed on one end of an operating rod 115, the other end of which is fitted to the pin 3A of the gripper-releasing plate 3.

Each transporting system is driven by a driving shaft 112 which is associated with the electromagnetic clutch brake 103 between the chains 102. As shown in FIG. 3, the driving shaft 112 at its either end is provided with the driving sprocket 104. The sprocket 104 and the follower sprocket 105 fixed to the roller shaft 51A, 58A, 92A, 95A are connected by the chain 102. Further, the follower sprocket 105 of the roller shaft 58A is provided with another sprocket of the same diameter, the latter sprocket serves as the driving sprocket 104 for the follower sprocket 105 fixed to the pulley shaft 37 of the paper-introducing path 30, the paper-receiving roller shaft 84A and the supporting shaft 86A of the roller 85. As shown in FIG. 4, the roller 85 itself may swing depending on the thickness of the paper set, so that the direct driving through the chain 102 is difficult. Therefore, the roller 85 is driven by the supporting shaft 86A of the swingable plate 86 and the gear 113 meshed with the shaft 86A and the roller shaft 85A.

As shown in FIG. 2, the follower sprocket 105 is provided with another sprocket of somewhat smaller diameter which serves as the driving sprocket 104. The sprocket 104 and the follower sprocket 105 (which is fixed to the electromagnetic clutch 116 arranged at the driving shaft 76 of the binding mechanism 70) are connected by the chain 102, thereby to drive the binding mechanism 70. Further, a take-up unit 119 of the chain 102 is provided, which comprises a sprocket meshed with the chain 102, a swingable plate supporting the sprocket, and a coil spring for urging the sprocket toward the chain 102.

The introduction of the paper and the discharge of the paper set from the binding mechanism 70 are carried out by normal rotation of the motor 101, while the discharge of the paper set from the bin drum 10 and the transportation thereof to the binding mechanism 70 are carried out by reversal rotation of the motor 101. When the rotation of the motor 101 is transmitted to each shaft, diameters of each pulley and each roller are determined so as to avoid different paper-transporting rate in each mechanism, while a reduction rate of the drum rotation is determined so as to achieve the paper-transporting rate from the gate roller 51 equal to the circumferential velocity of the inner stopper 14 in the shelf 11. With such driving mechanism, the bending and the clogging of the paper may be prevented upon introduction and discharge of the paper relative to the shelf 11.

The control mechanism for actuating the mechanisms described hereinabove in association with each other, comprises a micro-computer containing CPU, a clock generating element a memory and others, which controls a photo-sensor 120 arranged near the inlet of the path 30 for detecting the paper, an intermediate sensor 121 arranged in the path 30 spaced apart from the sensor 120 in a longer distance than the paper length, a sensor (not shown) arranged immediately behind the rollers 58 and 59 for the distributing mechanism, a sensor arranged behind the roller 84 for the binding mechanism, a sensor arranged in the discharging path 90 between the guide plates 94 for detecting the discharged paper, a system clock sensor 123 for detecting the slits 122A on a system clock disc 122 associated with the chain 102, as well as a sensor 124 for detecting the stop position of the drum 10 and detecting the slits 108A on a drum control disc 108 associated with the drum shaft 10A, and receives and treats signals therefrom for controlling the motor 101, each electromagnetic clutch brake 103, each gate 54, 60, 57 and the solenoid 65, 69 and others.

The operation of the control mechanism will be described hereinbelow, together with the operation for introducing and discharging the paper.

A power switch (not shown) in turned ON to actuate the gatherer according to the invention and to wait coming papers. In this phase the motor 101 starts to operate for rotating the rollers 51, 58 of the path 30 and the distributing mechanism 50 and for half-rotating the gripper shaft 110 to release the gripper in the shelf 11 for receiving the paper. Thus, the paper from the copying machine is introduced into the path 30. Through action of the pressure balls 33 in the path 30 and the inclined belt, the paper is moved with its one side edge being contacted with the guide plate 35 and is delivered from the path 30 into the shelf 11 via the distributing mechanism 50.

The inlet sensor 120 starts to operate the front and rear counters for the coming papers at the inlet. These counters are set by the signals of the leading and trailing edges of the paper generated from the intermediate sensor 121, a reference pulse of which may be obtained from the clock sensor 123 of the system clock disc 122.

Similarly, the intermediate sensor 121 is associated with the intermediate counters actuatable with the leading and trailing edges of the paper and may be reset by signals of the leading and trailing edges of the paper generated by the distributing sensor.

The four counters as described hereinabove may be utilized for detecting the clogged paper. Namely, the number of each counter above the given value indicates the clogging thereby to discontinue the motor 101 with the warning lamp 126 and the indication lamp of the clogging being turned on. The indication of the clogging may be obtained not only at the path 30 but also at other locations, such as the roller 58, the binding mechanism 70 and the discharging path 90 by a combination of the sensors and the counters. On the operator panel 125 are drawn a flow diagram 127 of the apparatus, on which are arranged the warning and the indication lamps 126, 128 of a photodiode corresponding to the location of each mechanism 10, 30, 50, 70, 90. Thus, the clogged location may be conveniently observed by any operator.

The paper size being transported may be confirmed by comparing the number of the operating counter with that of the previously operated counter. Namely, the number above the specified value indicates the smaller size of the paper, while the lower value indicates the larger size. If the paper introduced is of a different size, then the discharging gate 56 is turned on for discharging such paper into the receiver 91 arranged outside the frame 1. The paper size may also be confirmed by counting the system clock number between the leading and the trailing edges of the papers at the sensors 120, 121. However, the confirmation of the paper size by the inlet sensor 120 has a disadvantage in that the transporting rate is adversely affected by the discharging rate of the copying machine, while the confirmation through the intermediate sensor 121 has a disadvantage in that the delayed information from the sensor 121 affects adversely the distributing mechanism 50.

The paper in the path 30 is then introduced into the shelf 11 through the distributing mechanism 50 or passed over the bin drum 10.

The paper may be introduced into the shelf 11, as shown in FIGS. 9 and 10, by turning off the solenoid 65 and switching each gate 54, 61.

If the paper of different size is introduced or if excess number of papers are introduced, then the solenoid 69 is turned on for guiding the paper toward the discharging path 90.

When the first paper is introduced into the shelf 11, the signal from the distributing sensor actuates the counter. After the number of the counter reaches the specified value, the electromagnetic brake of the bin drum shaft 106 is turned off, while its clutch is turned on for rotating the drum 10 anticlockwise over the slit range of the shelf 11, as shown in FIG. 4, and for half-rotating the gripper shaft 110 through actuation of the electromagnetic clutch brake 103, thereby to hold the received paper.

The rotation control of the drum 10 may a achieved by means of the rotation angle detecting disc 108 and the stop position detecting sensor 124.

When the clutch of the electromagnetic clutch brake 82 is turned off and its brake is turned on through detection of the slit 108A, the drum 10 is regulated to the predetermined position. Then, the gripper driving shaft 110 is half-rotated to the receiving position for the corresponding shelf 11. Thus, the successive operation continues in the same way for receiving the papers in each shelf 11. Any excess paper over the capacity of the shelf 11 is guided by the distributing mechanism 50 toward the discharging path 90.

When a next paper is introduced into the shelf 11, the previously introduced papers are pressed downward by the shelf gate 60 to form a space for the next paper, so that the correct and rapid alignment of the papers may be achieved.

After the given number of copied papers have been introduced into the shelves 11, the binding switch is actuated to give a binding signal to the control mechanism. Then, the signal allows the motor 81 to rotate and the drum 10 to rotate anticlockwise at the specified angle from the paper-receiving position for starting discharge of the papers from the shelf 11. In this case, since the previously introduced papers are pressed by the shelf gate 60, the drum 10 is rotated in the reverse direction to release the shelf gate 60. Then, the motor 101 is driven in the reverse direction. Simultaneously, the solenoid 65 for the press gate 61 and the inlet gate 61 is energized for swinging the press gate 61 upward and the inlet gate 54 dowwnward. Then, the electromagnetic clutch brake 103 is actuated to turn off the brake and to turn on the clutch. Thus, the drum 10 starts to rotate clockwise, as shown in FIG. 4, while the gripper shaft 110 is half-rotated to release the holding of the paper set in the corresponding shelf 11. Then, the paper set is guided to the holding part of the reversally rotating rollers 58, 52 through rotation of the drum 10 and removal action of the shelf gate 60. When the paper set arrives at the holding part, it is guided to the receiving roller 84 of the binding mechanism 70 by the gate roller 51 and the press gate roller 52.

The reversal rotation of the drum 10 for discharging the paper set may be discontinued, similarly to the normal rotation, by the drum rotation angle detecting disc 108 mounted to the drum shaft end.

The paper set discharged from the drum 10 is detected by the paper-detecting sensor, a signal of which allows the motor 101 to discontinue its rotation. Simultaneously, the electromagnetic clutch 116 of the binding mechanism 70 is actuated to rotate its driving shaft 76 for binding and punching the paper set. One rotation of the driving shaft 76 actuates the microswitch through the concentric switch cam (not shown) to discontinue the rotation of the driving shaft 76 by means of the electromagnetic clutch 116. Simultaneously, the motor 101 is started to normally rotate and the solenoid 69 of the outlet gate 57 is turned on to be swung downward.

Thus, the paper set is discharged from the roller 84, transported through the gate 57 to the discharging path 90, and then discharged into the receiver 91. Similarly, other paper sets from other shelves are provided with the binding holes and discharged into the receiver 91.

The binding mechanism 70 may be, if necessary, provided with a perforation mechanism for another purpose.

The position of the flow diagram 127 on the panel 125 corresponding to each shelf 11 is provided with a pair of photodiodes in red and blue for the indication lamps 129, 130 each indicating the treating paper set on the treated paper set, respectively. A center position of the drum 10 in the flow diagram 127 is provided with a numerical indicator of two figures to form a page indicator 131.

In the drawings, numerical references 132, 133 and 134 represent an inlet gate opening indicator lamp, a stapler warning lamp for indicating the absence of needles and a drum opening indicator lamp, respectively, which are arranged at the corresponding positions to the mechanisms 30, 70 and 10. Further, the operation panel 125 is provided with a reset switch 35 for the clogging, a call service man indicator 136, a power lamp 137, an operating lamp 138, a switch 139 for generating a signal for binding, a switch 140 for allowing the unwanted paper to pass over, a manually introduction switch 141, a confirmation switch 142 for the paper set number, and corrective minus and plus switches 143, 144.

In addition, the distributing mechanism and the discharging path 90 are dividable from the transporting path and their upper portions may be swingable for convenient removal of the paper upon clogging.

In accordance with the invention, the bin drum 10 is in the generally cylindrical form and at its circumference is provided with a plurality of inclined shelves 11 circumferentially spaced apart each other, each of which shelves 11 is provided with the paper-holding means, so that the paper alignment may be readily achieved and the introduction and the discharge of the paper may be conveniently carried out. Further, with the compact construction, more number of papers may be aligned. In other words, the paper-receiving shelves 11 are arranged on the generally cylindrical bin drum 10 at its circumference, so that the conventional complicated construction, such as arrangement of a number of vertical shelves and their vertical movement for receiving the papers or arrangement of recycling path consisting of a belt for alignment of the papers, may be avoided, resulting in a compact and simple construction. Heretofore, a pair of annular belts are oppositely arranged for holding the papers for alignment the papers have been recycled, thereby to generate static electricity which affects adversely the introduction and the alignment of the papers. These disadvantages may be eliminated by receiving all papers in the shelves 11 for preventing the generation of static electricity in accordance with the invention.

Further, movement of the shelves 11 may be conveniently achieved simply through rotation of the bin drum 10 and the rotation of the drum may be readily controlled. Since the shelves 11 are arranged on the circumference of the drum 10, their movement may be conducted with much less energy and/or less labor in comparison with any conventional sorter having stepwise shelves. In addition, the introduction and the discharge of the papers may be conveniently achieved by simple rotation of the drum 10, resulting in compact and less complicated construction and control.

The inclined arrangement of the shelves 11 on the circumference of the drum 10 may facilitate the introduction and the discharge of the papers. In other words, the introduction and the discharge of the papers may be conveniently achieved simply through rotation direction of the drum 10.

Since the paper-transporting path is contacted with the drum 10 and the paper-distributing mechanism 40 is arranged at the contact position of the path 30 with the drum 10, the paper of different size or excess number of papers may be readily discharged with preventing the introduction thereof into the shelf 11. In accordance with the invention a plurality of gatherers may be arranged in series, so that much more number of paper sets may be handled.

Further, the binding mechanism 70 is arranged in the vicinity of the distributing mechanism 40, so that the alignment and the binding of the papers may be conveniently carried out without any trouble.

More particularly, in accordance with the invention, the reciprocable paper-size changing body 17 and the switching means for swinging the changing body 17 are provided, so that the switching of the paper-size may be conveniently achieved. Further, the paper of any size may be conveniently treated simply by operating the changing body and the switching means. Thus, without arranging a plurality of shelf gates, the papers of different sizes may be readily treated with single gate 60, resulting in a simple construction. In addition, variation of the paper size does not change the controlling time of each mechanism.

The binding mechanism 70 is movable on the rail along the paper edge and the moving means switchable depending on the paper size is provided, so that the paper set of any size may be readily bound at the accurate position.

Thus, the gatherer according to the invention has a number of advantages as described hereinabove and therefore is suitable for use in a high speed copying machine with correct and rapid gathering. Further, the gatherer according to the invention may be applied to any paper size notwithstanding its compact and simple construction.

What is claimed is:

1. A gatherer for papers, especially copied papers, which comprises a generally cylindrical bin drum having circumferentially thereon a plurality of inclined paper-receiving shelves circumferentially spaced apart from each other, means for rotating and counter rotating the drum, a paper-holding means arranged in each of the shelves, means for opening and closing the paper holding means, a paper-transporting path contacted to the bin drum, a paper-distributing mechanism situated at a location of the bin drum contacted with the paper-transporting path, and a binding mechanism arranged near the paper-distributing mechanism for binding a set of papers discharged from the bin drum and aligned, said bin drum being rotated by said means for rotating and counter rotating the drum over an open length of each shelf per one piece of paper in the paper-transporting direction for successively introducing the paper into the shelf and being rotated, after having finished the introduction of the paper, in the opposite direction over the open length of the shelf thereby to introduce the set of aligned papers into the binding mechanism.

2. A gatherer for papers, especially copied papers, which comprises a generally cylindrical bin drum having circumferentially thereon a plurality of inclined paper-receiving shelves circumferentially spaced apart from each other, means for rotating and counter rotating the drum, a paper-holding means arranged in each of the shelves, means for opening and closing the paper holding means, a paper-transporting path contacted to the bin drum, a paper-distributing mechanism situated at a location of the bin drum contacted with the paper-transporting path and a binding mechanism arranged near the paper-distributing mechanism for binding a set of papers discharged from the bin drum and aligned, and which further comprises, in each shelf of said bin drum, a paper size changing body capable of reciprocating a paper-engaging pawl from a notch of each shelf for engaging with a leading edge of the paper as well as a switching means for swinging the changing body, said bin drum being rotated by said means for rotating and counter rotating the drum over an open length of each shelf per one piece of paper in the paper-transporting direction for successively introducing the paper into the shelf and being rotated, after having finished the introduction of the paper, in the opposite direction over said open length of the shelf thereby to introduce the set of aligned papers into the binding mechanism which is movable on a rail arranged along an edge of the set of papers to be bound and which is provided with a moving means to be switched by the paper size so as to align a center of the binding mechanism with a central position of the edge of the set of papers.

* * * * *